US005146645A

United States Patent [19]

Dirksing

[11] Patent Number: 5,146,645

[45] Date of Patent: Sep. 15, 1992

[54] TOOTHBRUSH EMPLOYING RESILIENTLY BUCKLING ARCH TO INDICATE EXCESSIVE BRUSHING PRESSURE

[75] Inventor: Robert S. Dirksing, Cincinnati, Ohio

[73] Assignee: The Procter & Gamble Company, Cincinnati, Ohio

[21] Appl. No.: 663,214

[22] Filed: Mar. 1, 1991

[51] Int. Cl.[5] ..... A46B 5/02; A46B 9/04

[52] U.S. Cl. ..... 15/167.1; 15/143.1

[58] Field of Search ..... 15/167.1, 167.2, 143 R, 15/172

[56] References Cited

U.S. PATENT DOCUMENTS

| | | | |
|---|---|---|---|
| Re. 22,938 | 11/1947 | Kisky | 15/167 |
| D. 85,112 | 9/1931 | McGauley | 15/167.1 |
| 759,490 | 5/1904 | Yates . | |
| 1,131,863 | 3/1915 | Phillips . | |
| 1,132,326 | 3/1915 | Fouyer | 15/167.1 |
| 1,327,807 | 1/1920 | Burleigh . | |
| 1,471,626 | 10/1923 | Pachmayr . | |
| 1,722,131 | 7/1929 | Fitzgerald | 15/167.1 |
| 1,796,001 | 3/1931 | Church . | |
| 1,850,810 | 3/1932 | Schwerin . | |
| 1,914,240 | 6/1933 | Caldwell | 15/167.1 |
| 1,928,328 | 9/1933 | Carpentier | 15/167 |
| 2,083,217 | 6/1937 | Brothers et al. | 15/167 |
| 2,114,947 | 4/1938 | Warsaw | 15/167 |
| 2,139,094 | 12/1938 | Opolo | 74/523 |
| 2,219,753 | 10/1940 | Seguin | 15/188 |
| 2,224,788 | 12/1940 | Jobst | 15/167 |
| 2,254,365 | 9/1941 | Griffith et al. | 15/172 |
| 2,273,207 | 2/1942 | Kuhn | 15/167.1 |

(List continued on next page.)

FOREIGN PATENT DOCUMENTS

| | | |
|---|---|---|
| 260612 | 10/1912 | Fed. Rep. of Germany . |
| 283892 | 4/1915 | Fed. Rep. of Germany . |
| 554155 | 7/1932 | Fed. Rep. of Germany . |
| 155730 | 9/1932 | Fed. Rep. of Germany . |
| 3840136.3 | of 0000 | Fed. Rep. of Germany . |

(List continued on next page.)

OTHER PUBLICATIONS

Price List For Celluloid Brush Products, Gold Medal International Hygiene Exhibition Dresden 1911, Supplement to the Main Catalog, Jos. Ed. Faller Brush Manufacturer Todtnau (Baden).

Co-pending commonly assigned U.S. Patent Application of R. S. Dirksing, Ser. No. 662,852, filed Mar, 1, (List continued on next page.)

*Primary Examiner*—Philip R. Coe
*Assistant Examiner*—Terrence R. Till
*Attorney, Agent, or Firm*—E. Kelly Linman; Richard C. Witte; Thomas H. O'Flaherty

[57] ABSTRACT

A toothbrush employing a force indicator which visually and tactually signals the user that a predetermined brushing force has been exceeded. The force indicator is comprised of a resilient twin beam structure located between the toothbrush handle and the toothbrush head which includes a scrubbing or polishing medium, typically bristles. The twin beam structure is itself comprised of a back side beam and a face side beam. During normal use, the back side beam is subjected to compressive stress whereas the face side beam is subjected to tensile stress. The at rest configuration of the back side beam permits it to behave as an upwardly convex arch upon initial application of compressive force resulting from a user gripping the handle and bringing the bristles or other cleansing or scrubbing medium in contact with the teeth and gums. When a predetermined force is exceeded, the back side beam resiliently buckles and inverts to a downwardly convex arch configuration. In a preferred embodiment, the back side and face side beams are nonparallel with a convergent taper from the brush handle in the direction of the brush head. The disclosed twin beam structures resist deflection up to a predetermined force which is determined primarily by their material properties and their precise geometric configuration. Attempting to exceed the predetermined force which the toothbrush is capable of transmitting by applying additional manual force to the brush handle results in resilient buckling of the back side beam in the twin beam structure, followed by substantial deflection of the brush head relative to the brush handle without a corresponding increase in the force applied to the teeth and gum tissue via the bristles on the brush head.

15 Claims, 6 Drawing Sheets

U.S. PATENT DOCUMENTS

| | | | |
|---|---|---|---|
| 2,445,657 | 7/1948 | Bennett | 15/167 |
| 2,517,045 | 8/1950 | Soule | 15/176 |
| 2,631,320 | 3/1953 | Bressler | 15/167 |
| 2,660,745 | 12/1953 | Yusko | 15/22 |
| 2,706,825 | 4/1955 | Blakeman | 15/167.1 |
| 2,864,111 | 12/1958 | Rotceig | 15/167.1 |
| 3,193,864 | 7/1965 | Makowsky | 15/172 |
| 3,609,789 | 10/1971 | Slater | 15/167.1 |
| 3,691,587 | 9/1972 | Makowsky | 15/167 R |
| 3,994,038 | 11/1976 | Moulet | 15/167 R |
| 4,253,212 | 3/1981 | Fujita | 15/167 R |
| 4,356,585 | 11/1982 | Protell et al. | 15/111 |
| 4,461,053 | 7/1984 | Nitzsche et al. | 15/172 |
| 4,476,604 | 10/1984 | White et al. | 15/105 |
| 4,520,526 | 6/1985 | Peters | 15/167 R |
| 4,654,922 | 4/1987 | Chen | 15/172 |
| 4,667,360 | 5/1987 | Marthaler et al. | 15/167 R |
| 4,680,825 | 7/1987 | White et al. | 15/105 |
| 4,691,404 | 9/1987 | Tarrson et al. | 15/167 R |
| 4,691,405 | 9/1987 | Reed | 15/201 |
| 4,829,621 | 5/1989 | Phenegar | 15/172 |
| 4,864,676 | 9/1989 | Schaiper | 15/167.1 |
| 4,942,894 | 7/1990 | Lai | 132/323 |

FOREIGN PATENT DOCUMENTS

| | | | |
|---|---|---|---|
| 2402785 | 3/1979 | Fed. Rep. of Germany . | |
| 3414623 | 10/1985 | Fed. Rep. of Germany . | |
| 8622144.2 | 7/1987 | Fed. Rep. of Germany . | |
| 3612108 | 10/1987 | Fed. Rep. of Germany . | |
| WO88/06417 | 9/1988 | Fed. Rep. of Germany . | |
| 3805326 | 9/1988 | Fed. Rep. of Germany . | |
| 8903911.4 | 6/1989 | Fed. Rep. of Germany . | |
| 552210 | 11/1925 | France . | |
| 599790 | 1/1926 | France . | |
| 606938 | 6/1926 | France . | |
| 910591 | 6/1946 | France . | |
| 1247433 | 10/1960 | France . | |
| 1542567 | 10/1968 | France . | |
| 2053885 | 4/1971 | France . | |
| 485723 | 10/1953 | Italy . | |
| 8801480 | 3/1988 | PCT Int'l Appl. | 15/167.1 |
| 77944 | 9/1949 | Switzerland . | |
| 202424 | 8/1923 | United Kingdom | 15/144 R |
| 216355 | 5/1924 | United Kingdom | 15/176.1 |
| 476479 | 12/1937 | United Kingdom . | |
| 1005334 | 9/1965 | United Kingdom . | |
| 1164597 | 9/1969 | United Kingdom . | |
| 2081570 | 2/1982 | United Kingdom . | |

OTHER PUBLICATIONS 1991, entitled "Toothbrush Having Handle Joined To Brush Head by Non-Pinching Flexible Twin Beam Structure" (copy not included).

Co-pending commonly assigned U.S. Patent Application of R. Kirberger, Ser. No. 446,962 filed Dec. 6, 1989 entitled "Toothbrush" (copy not included).

Co-pending commonly assigned U.S. Patent Application of R. Kirberger, Ser. No. 429,741 filed Oct. 31, 1989 entitled "Toothbrush" (copy not included).

Co-pending commonly assigned U.S. Patent Application of K. Bartsch, Ser. No. 440,822 filed on Nov. 22, 1989 entitled "Toothbrush With A Deflecting Part Having A Deflection Profile" (copy not included).

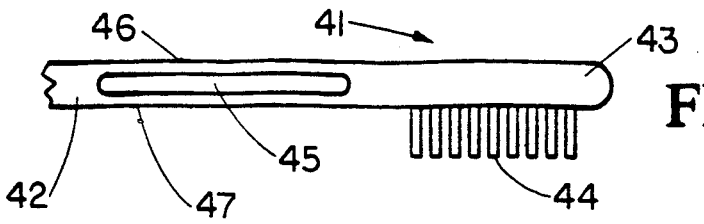
FIG. 4
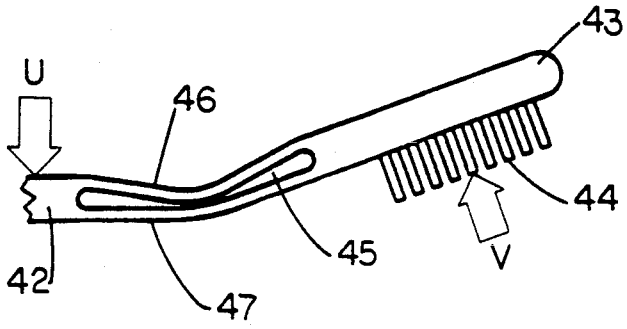
FIG. 5
FIG. 6
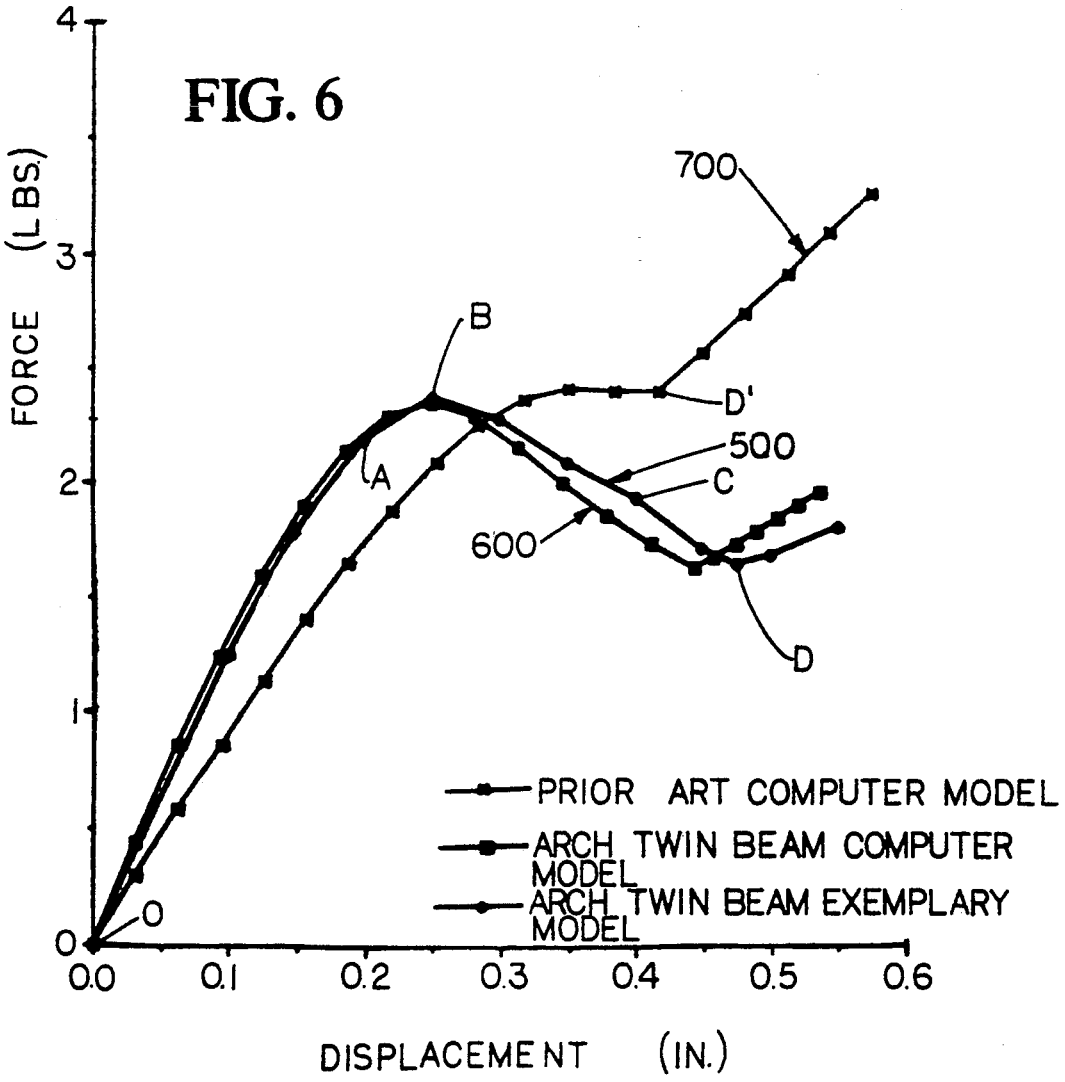

TOOTHBRUSH EMPLOYING RESILIENTLY BUCKLING ARCH TO INDICATE EXCESSIVE BRUSHING PRESSURE

TECHNICAL FIELD

The present invention relates to brushes and in particular to toothbrushes that eliminate or at least reduce damage to teeth and gum tissue due to the application of excessive manual force during brushing.

BACKGROUND OF THE INVENTION

It has been recognized for some time that vigorous brushing of the teeth with excessive force can cause damage to tooth material and gum tissue. Consequently, there have been attempts in the prior art to produce toothbrushes that yield in response to excessive manual force on the handle.

Toothbrushes having a flexible neck located between the brush head containing the bristles and the handle have been disclosed in the prior art. For example, U.S. Pat. No. 759,490 issued to Yates on May 10, 1904 discloses a toothbrush having an interposed piece of flexible resilient material between a rigid brush head and handle. The object of the flexible resilient neck is to permit the bristle head to yield relative to the handle when excessive force is applied, thus reducing the danger of injury to the teeth and gums. Yates further discloses reinforcing the flexible resilient material of the neck with a second flexible resilient material, such as flat or round wire comprised of spring steel, encased within the first material.

U.S. Pat. No. 1,471,626 issued to Pachmayr on Oct. 23, 1923 discloses a toothbrush having two cantilever flattened springs supporting a bristle carrying portion. However, the purpose of the flattened springs is not to limit the forces transmitted to the teeth and gums, but to engage a boss which secures the bristle carrying portion in either a parallel or angular position relative to the brush handle.

U.S. Pat. No. 4,520,526 issued to Peters on Jun. 4, 1985 discloses a toothbrush having a flexible joint between the head portion and handle portion. This flexible joint permits the head portion to flex in a vertical plane relative to the handle portion. One means disclosed to produce such a flexible joint is by thinning the toothbrush body by removing material from the top and/or bottom of the toothbrush body. The thinning at the flexible joint weakens the flexible portion, permitting the head portion to flex relative to the handle portion during brushing. Alternatively, Peters discloses a hollow which extends horizontally through the body member of the toothbrush forming a flexible joint comprising a thin top resiliently flexible horizontal member and a thin bottom resiliently flexible horizontal member. The purpose is again to weaken the body member to form a flexible portion which permits the head portion to flex relative to the handle portion during brushing. The object of such prior art toothbrushes is to provide a brush head which deflects relative to the brush handle in direct response to applied pressure to avoid damaging tooth material and gum tissue. While actual executions vary, the technique of such prior art toothbrushes is to lessen the rigidity of the neck portion by removing material or by substituting a less rigid material in the neck portion. The principal of operation of such prior art flexible neck toothbrushes is the same, i.e., increasing the force on the handle results in a corresponding deflection of the brush head relative to the brush handle. For effective cleaning of the teeth, some pressure needs to be applied to the brush head by the user. With prior art flexible neck toothbrushes of the type described in the preceding paragraphs, deflection of the brush head corresponds directly to the applied force on the handle, i.e., the flexible joint connecting the handle and the brush head behaves as a simple spring constant. With no clear indication of excessive pressure, the user applies his or her customary manual force on the brush handle and compensates for the resulting deflection by adjusting to the resulting angle of the brush head relative to the handle.

Although the desired object of prior art flexible neck toothbrushes is to avoid damaging teeth or gums, the disclosed means for accomplishing this is to simply reduce the stiffness of the neck portion of the toothbrush and thereby force the user to compensate by bending the brush handle to a greater degree. In this respect, none of the aforementioned flexible neck toothbrushes of the prior art provide means to indicate excessive pressure other than some ambiguous amount of bending. Further, excessive bending of the brush head relative to the brush handle makes the toothbrush annoying to use, and the accompanying loss of brush control can itself result in tissue damage.

One attempt to overcome problems of the aforementioned type is disclosed in U.S. Pat. No. 4,476,604 issued to White et al. on Oct. 16, 1984. White discloses a pressure sensing device for holding a toothbrush for the purpose of indicating that a predetermined force is being applied against the teeth. Although the device provides a distinct signal upon attaining a predetermined force and further achieves this result with minimal deflection of the brush head relative to the handle, the solution disclosed by White is complex and requires an electric battery, a lightbulb and an electric circuit.

OBJECTS OF THE INVENTION

Accordingly, it is an object of this invention to provide an improved toothbrush having a force indicator which limits the application of brushing force against tooth surfaces and gum tissue to a predetermined value and which clearly signals the user when the predetermined force has been exceeded.

It is a further object of this invention to minimize the deflection of the toothbrush head relative to the handle up until the predetermined force has been exceeded so that the user is not required to continually compensate for unwieldy movement of the brush head during brushing.

It is still a further object of this invention to provide a toothbrush which provides a clear visual and tactile signal to the user that the predetermined force has been exceeded.

DISCLOSURE OF THE INVENTION

A toothbrush having a brush head joined to a brush handle by means of a twin beam structure comprising a face side beam on the bristle side of the brush and a back side beam opposite the face side beam. The twin beam structure, which acts as a force indicator, resists deflection of the brush head relative to the brush handle up to a predetermined force above which the back side beam resiliently buckles, resulting in significant deflection of the brush head relative to the brush handle. This resilient buckling provides a limit to the amount of force which can be applied to the teeth and gums by the brush head and a distinct signal to the user that the predetermined force has been exceeded.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

FIGS. 4 and 5 are partial side views of a flexible neck toothbrush of the prior art in an at rest and flexed condition, respectively;

FIG. 6 is a force/deflection graph for an exemplary embodiment of a toothbrush of the present invention, a computer model of the exemplary toothbrush of the present invention, and a computer model of a flexible neck toothbrush of the prior art;

DETAILED DESCRIPTION OF THE PREFERRED EMBODIMENTS

Figure 1:
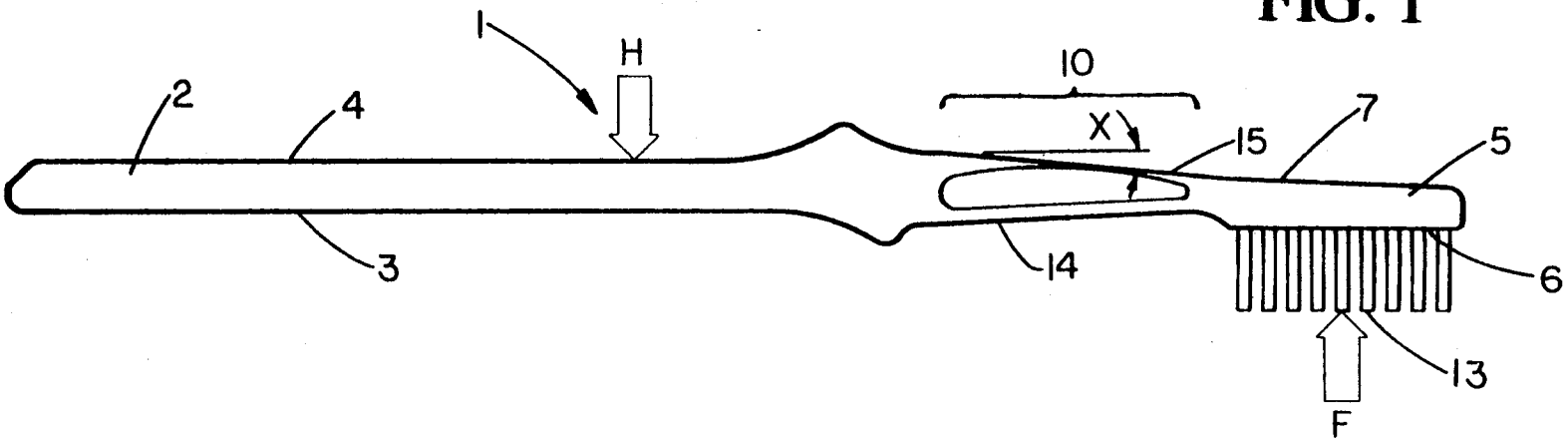
FIGS. 1, 2, and 3 are side elevation views of a toothbrush of the present invention at various stages of brush head deflection.

In FIG. 1 a toothbrush of the present invention, generally denoted by 1, is shown. It includes a brush handle 2 having a face side 3 and a back side 4, a brush head 5 having a face side 6 with attached bristle bundle 13 and a back side 7, and a force indicator 10 connecting brush handle 2 to brush head 5.

Force indicator 10 comprises a resilient twin beam structure having a face side beam 14 and an back side beam 15. Face side beam 14 extends between the face side 3 of handle 2 and the face side 6 of brush head 5. Back side beam 15 extends between and is substantially rigidly connected to the back side 4 of handle 2 and the back side 7 of brush head 5.

The general plane of back side beam 15 tapers relative to the general plane of face side beam 14 from brush handle 4 toward brush head 5 at angle "X". In use, manual force is applied to brush handle 2 to bring bristle bundles 13 in contact with the surfaces of teeth and gums of the user. When an initial force is applied to the back side 4 of brush handle 2, as indicated by the bold arrow "H", a reactionary force is applied to the bristle bundles 13 by the teeth and gums, as indicated by the bold arrow "F". Force "H" applied to brush handle 2 is translated to brush head 5 via force indicator 10.

Figure 1A:
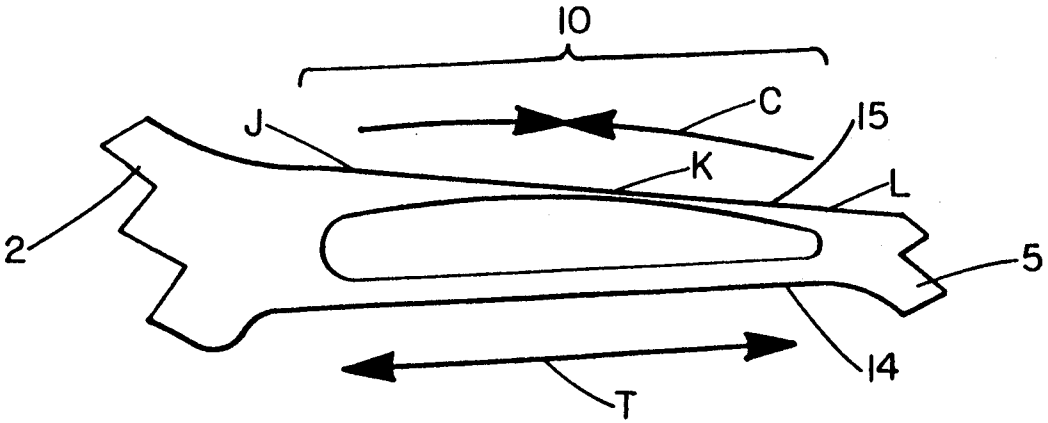
FIGS. 1A, 2A, and 3A are enlarged partial side views of the toothbrush shown in FIGS. 1, 2, and 3, respectively.

FIG. 1A is an enlarged partial section of the toothbrush of FIG. 1 with particular emphasis on force indicator 10. In translating force from brush handle 2 to brush head 5, face side beam 14 is subjected to tensile stress, as indicated by the arrow set "T", while back side beam 15 is subjected to compressive stress, as indicated by the arrow set "C".

Figure 2:
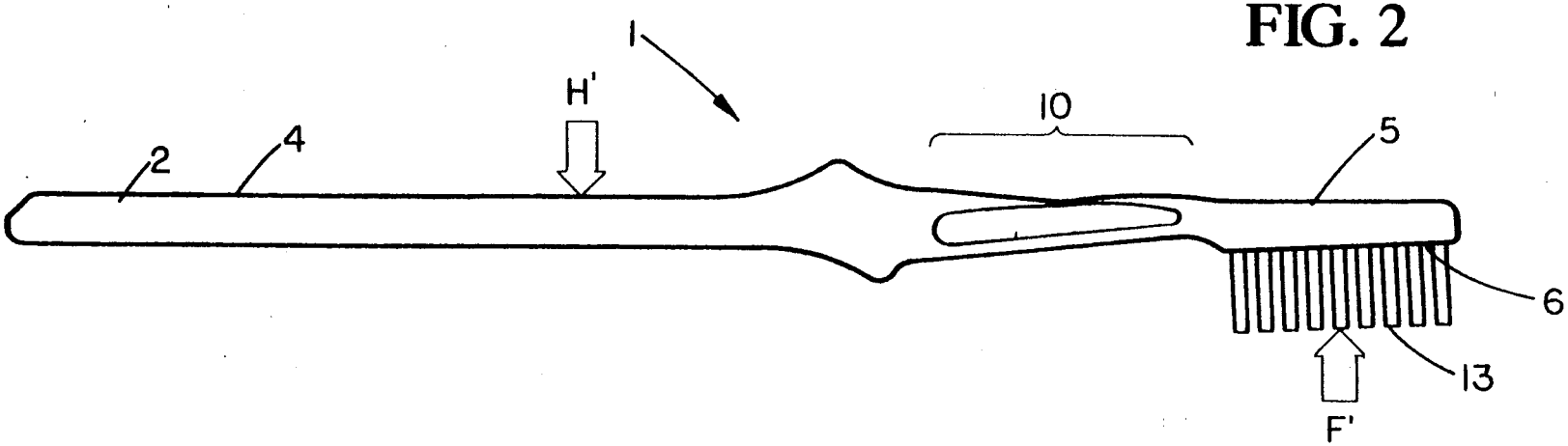

The at rest configuration of back side beam 15 permits the back side beam 15 to behave as an upwardly convex arch when subjected to initial compressive stress. The taper of the back side beam 15 relative to face side beam 14 at angle "X" provides a vertical component which stiffens the twin beam structure of force indicator 10. Back side beam 15 also includes a taper in cross-section from point "J" at the junction of back side beam 15 with the back side 4 of brush handle 2 toward point "K" and from point "L" at the junction of back side beam 15 with the back side 7 of brush head 5 toward point "K", forming a point of weakness at point "K". FIG. 2 shows toothbrush 1 with an increased force applied to the back side 4 of handle 2, as indicated by the bold arrow "H'", opposed by reactionary force "F'" applied to the bristle bundles 13 of brush head 5, as indicated by the bold arrow "F'".

Figure 2A:
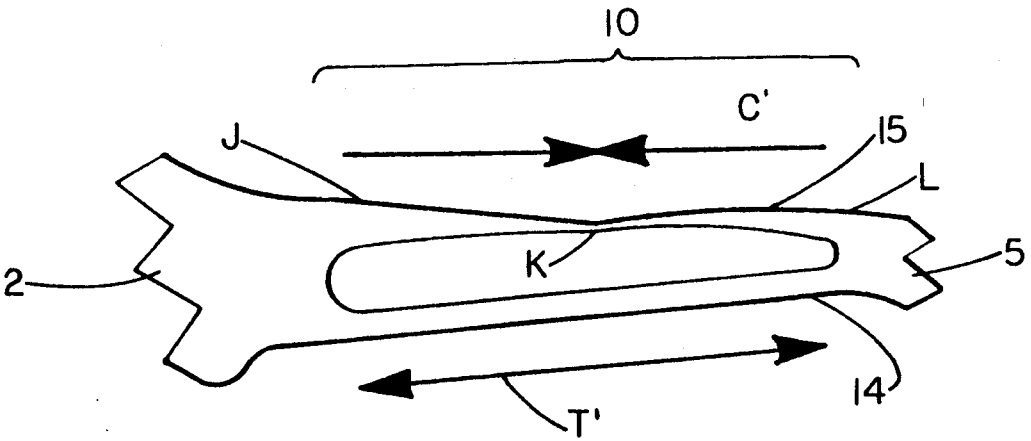

FIG. 2A is an enlarged partial section of toothbrush 1 of FIG. 2. The increased force translation through force indicator 10 generates increased tensile stress in face side beam 14 and increased compressive stress in back side beam 15. The increased compressive stress in back side beam 15 resiliently deforms back side beam 15 and permits limited displacement of brush head 5 in the same direction as reactionary force "F'". Point "L" is similarly displace relative to point "K" on back side beam 15 so that the compressive stresses in back side beam 15 approach a more linear alignment, as indicated by the arrow set "C". The limited resilient deformation of back side beam 15 permits face side beam 14 to bend counterclockwise to a limited degree relative to brush handle 2.

Figure 3:
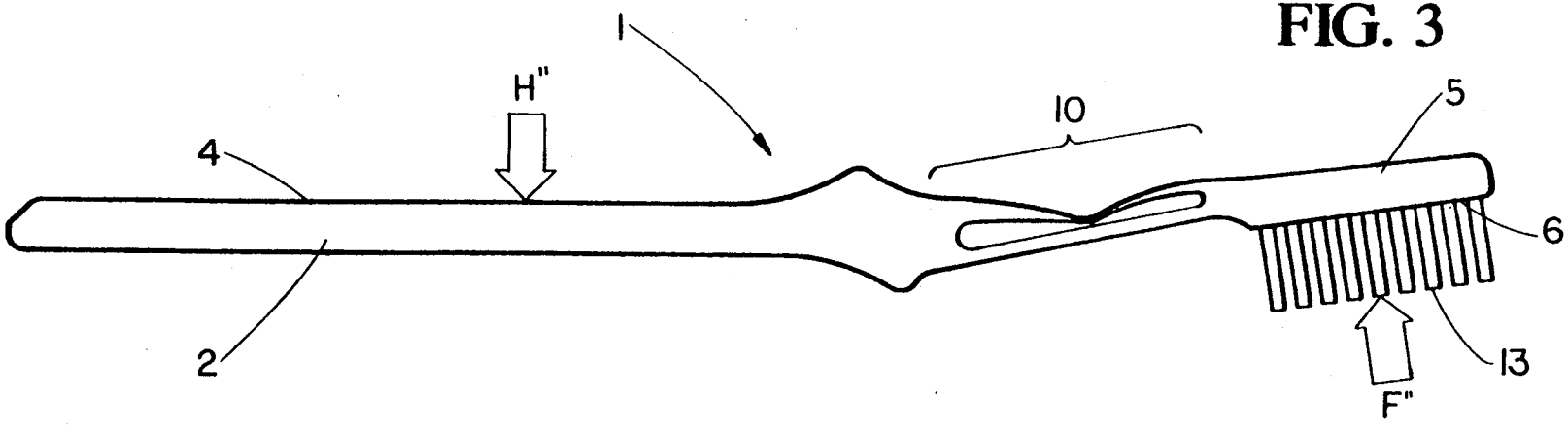

FIG. 3 shows toothbrush 1 with a further increased force applied to the back side 4 of handle 2, as indicated by the bold arrow "H'" opposed by a reactionary force "F'" applied to the bristle bundles 13 of brush head 5, as indicated by the bold arrow "F'".

Figure 3A:
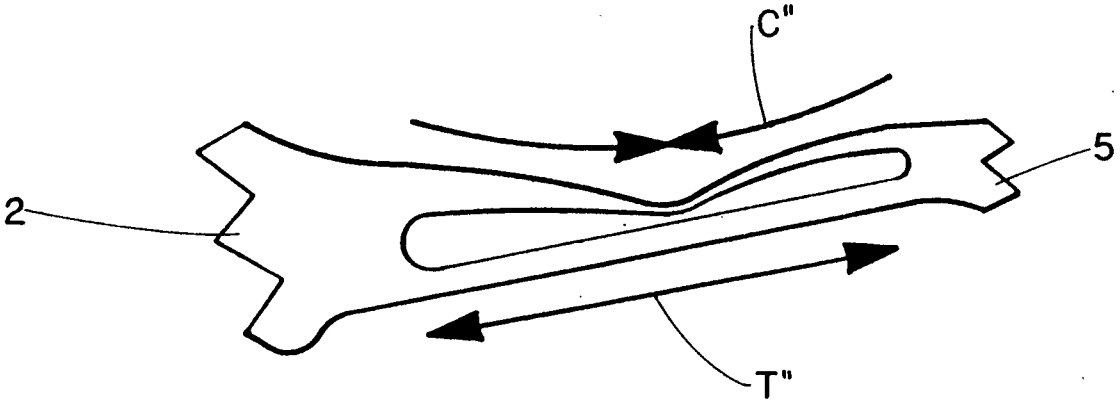

FIG. 3A is an enlarged partial section of the toothbrush 1 of FIG. 3. Increased angular displacement of brush head 5 relative to brush handle 2 beyond that shown in FIGS. 2 and 2A, wherein the compressive stresses in back side beam 15 are in relative alignment, permits resilient deformation and buckling of back side beam 15 causing it to invert to a downwardly convex arch, as generally shown in FIGS. 3 and 3A. This configuration causes a collapse in the force translation capacity of force indicator 10, thereby permitting further rapid displacement of brush head 5 relative to brush handle 2. This event is sometimes termed "over-center" or "oil can" effect. It is both visually and tactually perceived by the user of the toothbrush and is intended to provide a signal to the user to relieve the excessive applied pressure so that the brush can resiliently restore itself to its at rest configuration, as shown in FIG. 1 before the user resumes the brushing process.

FIGS. 4 and 5 illustrate the operation a flexible neck toothbrush of the type disclosed in the prior art. FIG. 4 is a partial side view of such a prior art toothbrush 41. Toothbrush 41 comprises a brush handle 42, a brush head 43 having attached bristle bundles 44, and a shaped hollow 45 forming flexible members 46 and 47 in the neck area. In FIG. 5, a force "U" is shown applied to toothbrush handle 42 which is opposed by a reactionary force "V" which is applied to the bristle bundles 44 of brush head 43. Unlike the arched twin beam structure of the present invention, the planar configuration of the prior art horizontal flexible members permits immediate downwardly convex bending of uppermost flexible member 46. In FIG. 5, the interior of flexible member 46 is just about to contact the interior of flexible member 47. The transition between the at rest condition of prior art toothbrush 41 illustrated in FIG. 4 to the stressed condition of prior art toothbrush 41 illustrate in FIG. 5 occurs without the benefit of a distinct signal to the user that a predetermined force has been exceeded.

FIG. 6 is a Force/Displacement graph containing three curves: one for an exemplary embodiment of an arched twin beam toothbrush of the present invention, such as embodiment 1 shown in FIGS. 1-3A; one for a computer generated Finite Element Analysis model of a toothbrush having the structure of the exemplary embodiment; and one for a computer generated Finite Element Analysis model of a flexible neck toothbrush of the prior art, such as the one shown in FIGS. 4 and 5.

The polymeric material of the exemplary integrally molded embodiment of the present invention used to generate the experimental data shown as curve 500 in FIG. 6 was general purpose polyporpylene homopolymer with a flexural modulus of 210,000 psi. Force indicator 10 of the exemplary embodiment measured 1.12 in. long with a taper of the general plane of back side beam 15 relative to the general plane of face side beam 14 (angle "X" in FIG. 1) of 5 degrees. Face side beam 14 measured 0.06 in. thick and back side beam 15 tapered from 0.10 in. at point "J" and 0.06 in. at point "L[ to 0.035 in. at point "K". The average width of back side beam 15 measured 0.25 in. and the average width of face side beam 14 measured 0.38 in.

The method used to generate the "Arch Twin Beam Exemplary Model" curve data shown as curve 600 in FIG. 6 was an INSTRON EXTENSOMETER, as available from Instron Corporation of Canton, Mass. This is a commonly used industrial tool to analyze the response of materials and structures to applied forces.

The Force/Displacement curves 600 and 700 in FIG. 6 of the "Arch Twin Beam Computer Model" and the "Prior Art Computer Model", respectively, were generated using a computer Finite Element Analysis (FEA) system modeling tool known as ABAQUS, as available from HKS, Inc. of Providence, R.I. Finite Element Analysis is a commonly used tool to analyze the response of mechanical components to applied forces. The dimensions and material characteristics of the exemplary model of the toothbrush of the particularly preferred embodiment were used as input for the "Arch Twin Beam Computer Model".

Dimensions for the flexible neck toothbrush of the prior art used in the Finite Element Analysis were 1.12 in. long by 0.06 in. high by 0.38 in. wide for shaped hollow 45 and 0.06 for the thickness of flexible member 46 and 47. The flexural modulus of 210,000 psi of general purpose polyporpylene homopolymer was again used as the material characteristic.

The vertical axis of the graph in FIG. 6 represents force in pounds applied to the center of the brush face in each case and the horizontal axis represents the displacement of the center of the brush face in inches in response to the applied force, as measured from each brush head's at rest position. Point "O" on the graph is the origin and represents the initial application of force.

The closed match of the curves 500 and 600 or the Arch Twin Beam Exemplary Model and the Arch Twin Beam Computer Model, respectively, demonstrates that the computer model is a good representation of the experiential data and is able to predict the reaction to applied force with a reasonably high level of accuracy.

Referring to FIG. 6 and the Force/Displacement curve 500 of "Arch Twin Beam Exemplary Model" of the present invention, the stiffened arch configuration of the back side beam 15 of force indicator 10 of the present invention permits just 0.25 inches of displacement of brush head 5 relative to brush handle 2 from 0 (point "O" in FIG. 6) to about 2.25 pounds of force (point "A" in FIG. 6)

Point "B" on curve 500 represents the force which resiliently deforms back side beam 15 of toothbrush 1 into the configuration where the compressive forces in back side beam 15 are in substantial linear alignment, as generally shown in FIG. 2A. Attempting to apply additional force beyond the level indicated as point "B" on curve 500 causes back side beam 15 to resiliently buckle into a downwardly convex arch, resulting in substantial loss in force translation capacity of force indicator 10, accompanied by substantial displacement of brush head 5 relative to brush handle 2. The rapid reversal in force translation capacity enables the force indicator 10 of the present invention to tactually and visually indicate to the user that a predetermined force has been exceeded.

While not an absolute requirement of the present invention, the region of formed weakness at point "K" in back side beam 15, as generally shown in FIG. 1, enhances the aforementioned resilient buckling behavior to make the user acutely aware that the predetermined force limit has been exceeded.

Point "C" on curve 500 of the "Arch Twin Beam Exemplary Model" corresponds substantially to the configuration of toothbrush 1 shown in FIG. 3, where back side beam 15 has inverted to a downwardly convex arch. Point "D" on curve 500 represents the point at which the interior surface of back side beam 15 contacts the interior of surface of face side beam 14. Beyond point "D", on curve 500, force translation through force indicator 10 increases but the excessive displacement of brush head 7 relative to brush handle 2 positions the handle 2 in an awkward angle for brushing. Rather than continuing to brush with the twin beam structure in a buckled condition, it is expected that the user will relieve the applied force so that back side beam 15 can resiliently reset to its upwardly convex configuration, as generally shown in FIG. 1, before resuming brushing.

Referring to the "Prior Art Computer Model" curve 700 in FIG. 6, which predicts the behavior of a prior art flexible neck toothbrush of the type shown in FIGS. 4 and 5, point "O" on the graph of FIG. 6 is the origin and represents the initial application of force. Point "D" on the "Prior Art Computer Model" curve 700 corresponds to the condition of prior art toothbrush 51 in FIG. 5, wherein the interior surface of flexible beam 46 contacts the interior surface of flexible beam 47. As can be seen from a comparison of curve 700 with curves 500 and 600 in the graph of FIG. 6, horizontal flexible members 46 and 47 of prior art flexible neck brush 41 do not produce the distinct resilient buckling behavior of the outwardly convex arch of the force indicator 10 of the present invention.

As can be seen from FIG. 6, flexible neck toothbrushes, such as toothbrush 41 of the prior art require substantial deflection of the brush head 43 relative to the brush handle 42 just to bring the bristles 44 into effective contact with the user's teeth. It is contemplated that such prior art brushes will likely be used in a substantially deflected condition throughout the brushing process. Accordingly, a user of a prior art flexible neck toothbrush must compensate for this relatively large deflection of the brush head by rotating the handle at an angle relative to the brush head during brushing.

Since access to the oral cavity is limited, the deflected position of the brush head of prior art flexible neck toothbrushes relative to the handle requires additional stretching of the mouth in order to maintain contact of the bristles with the tooth and gum surfaces. Furthermore, each time the bristles of prior art flexible neck toothbrushes lose contact with a tooth's surface, such as at the end of a vertical brushing stroke, the brush head springs to its at rest position. Not only does the user need to re-establish the desired force and its required deflection for the next brushing stroke, but the stored spring energy of the flexible neck has the potential to cause tissue damage as the brush head rebounds to its at rest position.

FIGS. 7 through 12 depict alternative toothbrush embodiments of the present invention.

Figure 7:
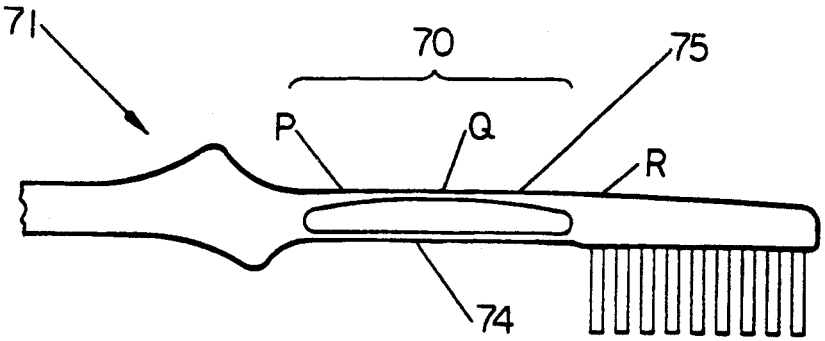
FIG. 7 is an enlarged partial side elevation view of alternative toothbrush of the present invention.

FIG. 7 is a partial view of toothbrush 71 of the present invention which includes force indicator 70. Force indicator 70 comprises back side beam 75 and face side beam 74. The general plane of back side beam 75 is parallel with the general plane of face side 74. Back side beam 75 tapers from points "P" and "R" to "Q" to form an arch. The at rest configuration of back side beam 75, i.e. and arch, permits back side beam 75 to behave as an upwardly convex arch when subjected to initial compressive stress. Any attempt to translate force beyond a predetermined level through force indicator 70 will cause back side beam 75 to undergo resilient buckling and invert to a downwardly convex arch.

The parallel alignment of the general planes of backside beam 75 and face side beam 74 of the FIG. 7 embodiment does not provide the same vertical component nor the same degree of stiffening as the twin beam structure 10 disclosed in FIGS. 1–3A. As a result, twin beam structure 70 exhibits a lower spring constant or a less stiff structure than tapered twin beam structure 10 shown in FIG. 1.

Nonetheless, the upwardly arched configuration of back side beam 75 still exhibits the same general type of resilient deformation and buckling as back side beam 15 when a predetermined force is exceeded, thereby causing it to invert from an upwardly convex arch to a downwardly convex arch configuration generally similar to that shown in FIGS. 3 and 3A. This invention of the arch provides a visual and tactile signal to the user that the particular predetermined force which the brush was designed to exert has been exceeded.

Figure 8A:
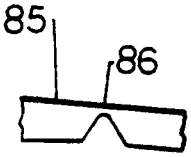
FIG. 8A is a greatly enlarged side elevation view of the inset 8A shown in FIG. 8.
Figure 8:
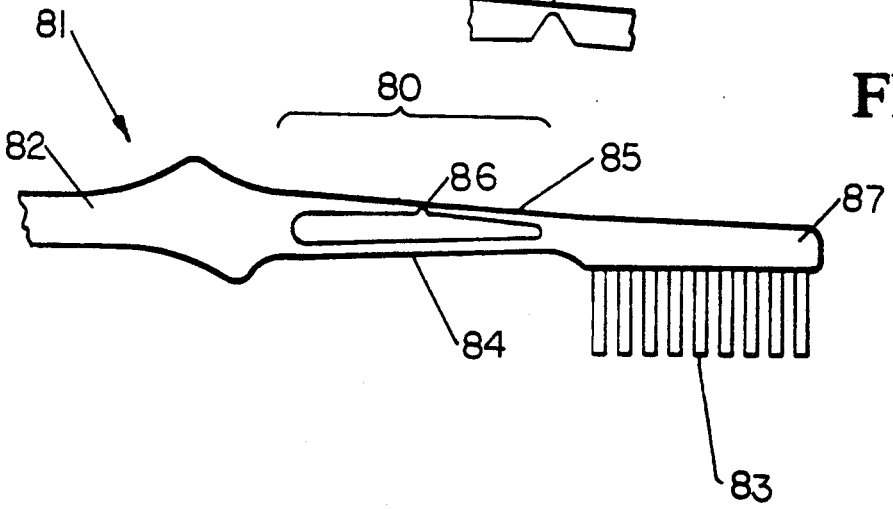
FIG. 8 is an enlarged partial side view of another toothbrush of the present invention.

FIG. 8 shows a partial side view of another toothbrush 81 of the present invention, wherein the force indicator 80 comprises face side beam 84 and back side beam 85. Back side beam 85 includes a hinge 86. FIG. 8A is an enlargement of the detail of hinge 86 in back side beam 85. Hinge 86 may be integrally molded of a polymeric material such as polypropylene to provide what is known to those skilled in the art as a "living hinge". The location of hinge 86 at the upper surface of back side beam 85 enables it to concentrate applied compressive stress along the upper surface of back side beam 85 so that in its at rest configuration, back side beam 85 behaves as an upwardly convex arch when subjected to initially applied compressive forces.

In use, manual force is applied to brush handle 82 in order to bring bristly bundles 83 into contact with the user's teeth and gums. Force indicator 80 translates the applied force from handle 82 to the brush head 87. At some predetermined force, which is determined primarily by such factors as the material of construction and the precise geometric configuration of the twin beam structure (particularly the back side beam 85), back side beam 85 resiliently buckles and inverts to a downwardly convex arch configuration. The relatively small cross-section of hinge 86 generates little resistance to bending. Accordingly, the lack of bending resistance permits back side beam 85 to resiliently deform and buckle quite rapidly, providing a very distinct tactile and visual signal to the user that the predetermined force has been exceeded.

Figure 9:
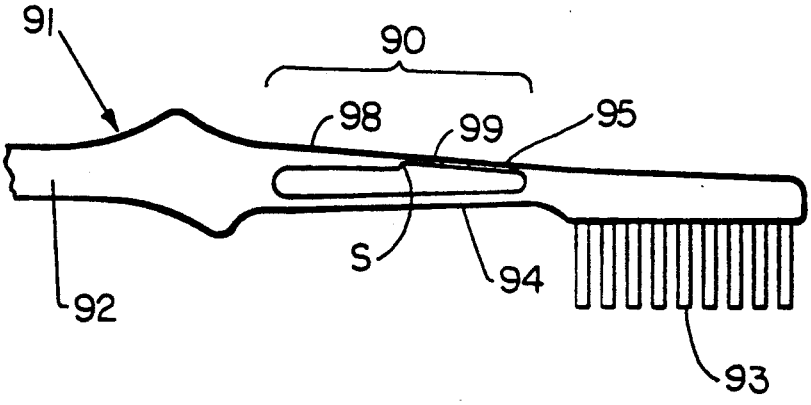
FIG. 9-12 are enlarged partial side elevation views of still other toothbrushes of the present invention.

FIG. 9 is a partial side view of still another toothbrush 91 of the present invention, wherein the force indicator 90 comprises face side beam 94 and back side beam 95. Back side beam 95 further comprises beam segment 98 and beam segment 99 which form a stepped cross-section. The cross-section transitions from a greater cross-section along beam segment 98 to a lesser cross-section along beam segment 99 at point "S". The cross-section step formed at point "S" enables the lesser cross-section beam segment 99 to concentrate applied compressive stress at the upper surface of the greater cross-section beam segment 98 so that in its at rest configuration, back side beam 95 behaves as an upwardly convex arch when subjected to initially applied compressive forces.

In use, manual force is applied to brush handle 92 in order to bring bristle bundles 93 into contact with the user's teeth and gums. Force indicator 90 translates the applied force from handle 92 to brush head 97. Because of the lesser cross-section of beam segment 99, most of the initial resilient deformation of back side beam 95 in response to the compressive forces initially applied to back side beam 95 occurs in beam segment 99. The deformation of beam segment 99 permits back side beam 95 to resiliently buckle when some predetermined force which the brush is designed to apply is exceeded, thereby causing back side beam 95 to invert to a downwardly convex arch configuration. The resilient buckling and inversion of back side beam 95 provides a clear visual and tactile signal to the user that a predetermined force has been exceeded.

Figure 10:
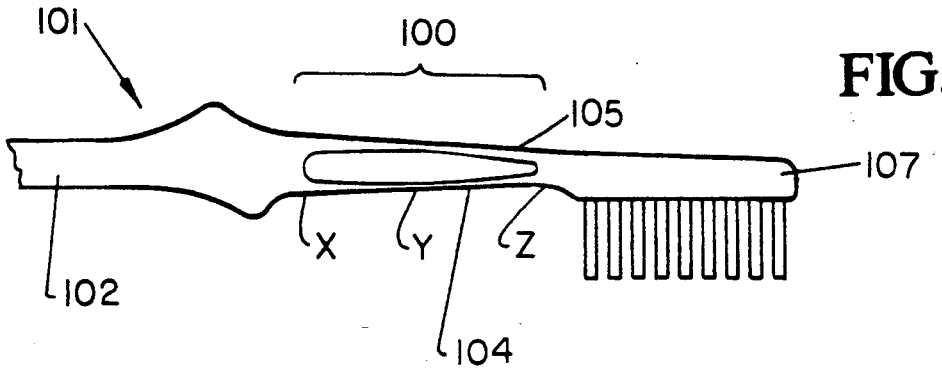

FIG. 10 is a partial side view of yet another toothbrush 101 of the present invention. Force indicator 100 comprises face side beam 104 and back side beam 105. Back side beam 105 is thinnest near its center and is configured as an upwardly convex arch. Face side beam 104 tapers from points "X" and "Z" to point "Y" so as to form a downwardly concave arch. During brushing, initial translation of force through force indicator 100 causes back side beam 105 to behave as an upwardly convex arch. The reduced cross-section of face side beam 104 at point "Y" concentrates the bending of face side beam 104 at point "Y" when brush head 107 is deflected relative to brush handle 102. Nonetheless, like the toothbrush embodiments described earlier herein, face side beam 104 is subjected to tensile stress throughout the brushing operation. Accordingly, it bends rather than buckles as force indicator 100 translates force between the brush handle 102 and brush head 107.

Figure 11:
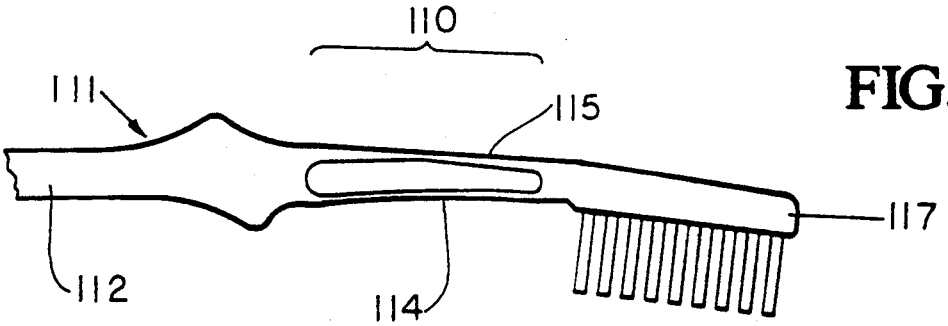

FIG. 11 is a partial side view of another toothbrush 111 of the present invention, wherein the force indicator 110 comprises face side beam 114 and back side beam 115. Both back side beam 115 and face side beam 114 are initially configured as upwardly convex arches in their at rest condition. The resulting upwardly arched configuration of force indicator 110 tilts the general plane of brush head 117 slightly downward relative to the general plane of brush handle 112. Nonetheless, toothbrush 111 functions in a manner generally similar to the previously described embodiments.

Figure 12:
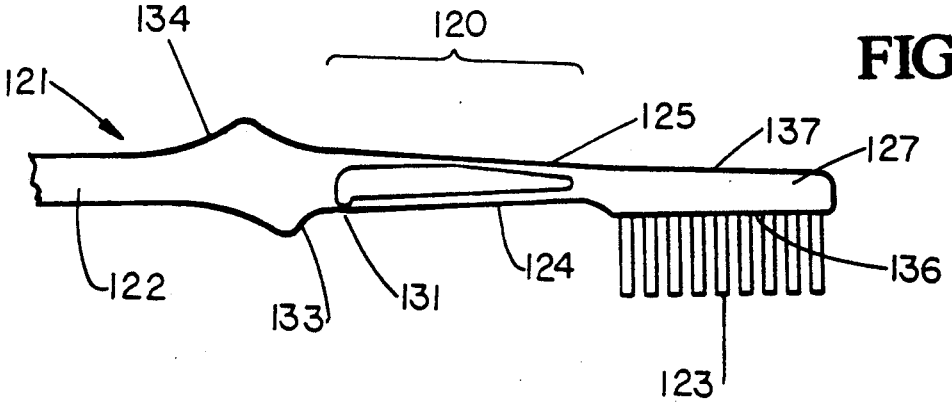

FIG. 12 is a partial side view of still another toothbrush 121 of the present invention, wherein the force indicator 120 comprises face side beam 124 and back side beam 125. Face side beam 124 extends between and is hingedly connected to face side 133 of handle 122 at hinge 131 and substantially rigidly connected to face side 136 of brush head 127. Back side beam 125 extends between and is substantially rigidly connected to back side 134 of handle 122 and back side 137 of brush head 127.

In use, manual force is applied to brush handle 122 in order to bring bristle bundles 123 into contact with the user's teeth and gums. Force indicator 120 translates the applied force from handle 122 to brush head 127. Face side beam 124 is subjected to tensile force and rotates about a point of formed weakness at hinge 131 as back side beam 125 resiliently deforms in response to force applied to handle 122 and opposed by the reaction force applied at bristle bundles 123. Hinge 131 generally defines a point of rotation of brush head 127 relative to brush handle 122. When some predetermined force which the toothbrush is designed to transmit to the user's teeth and gums is exceeded, back side beam 125 resiliently buckles and inverts to a downwardly convex arch configuration, thereby providing a visual and tactile signal to the user that the predetermined force has been exceeded.

From the foregoing descriptions of particularly preferred toothbrush embodiments of the present invention it will be understood that altering the cross-sections of back side and face side beams of the force indicator of the present invention will modify the stiffness of the resulting twin beam structure and consequently the distinctness of the buckling point which tactually and visually signals the user that the predetermined force which the brush was designed to transmit to the user's teeth and gums has been exceeded.

While bristle bundles are commonly used for scrubbing and cleansing of teeth and gums, the present invention may be employed with equal effectiveness with other scrubbing or polishing media, such as elastomeric bumps, foams, etc.

While particular embodiments of the present invention have been illustrated and described, it would be obvious to those skilled in the art that various changes and modifications can be made without departing from the spirit and scope of the present invention. It is intended to cover, in the appended claims, all such modifications that are within the scope of this invention.

What is claimed is:

1. A toothbrush comprising a handle having a face side and a back side opposite said face side and a brush head having a face side which carries a cleansing medium for cleaning the user's teeth and gums and a back side opposite said face side, said toothbrush further including a force indicator which simultaneously visually and tactually signals the user when a predetermined brushing force is exceeded, said force indicator comprising a resilient twin beam structure having a first end connected to said brush handle and a second end connected to said brush head, said resilient twin beam structure comprising a face side beam extending between said face side of said handle and said face side of said brush head and a back side beam extending between and substantially rigidly connected to said back side of said handle and said back side of said brush head, said back side beam exhibiting an arched at rest configuration including a point of formed weakness intermediate said first end and said second end of said resilient twin beam structure which will permit said back side beam to behave as an upwardly convex arch when said back side beam is initially subjected to compressive stress and said face side beam is initially subjected to tensile stress resulting from the user gripping said handle and bringing the cleansing medium on said brush head in contact with their teeth and gums, the predetermined force which may be exerted on the user's teeth and gums being limited by the maximum compressive force which said back side beam can resist before it ceases to function as an upwardly convex arch and undergoes temporary and resilient buckling and deformation sufficient to cause it to invert to a downwardly convex configuration, thereby providing a simultaneous visual and tactile signal to the brush user that a predetermined brushing force has been exceeded.

2. A toothbrush comprising a handle having a face side and a back side opposite said face side and a brush head having a face side which carries bristles for cleaning the user's teeth and gums and a back side opposite said face side, said toothbrush further including a force indicator which simultaneously visually and tactually signals the user when a predetermined brushing force is exceeded, said force indicator comprising a resilient twin beam structure having a first end connected to said brush handle and a second end connected to said brush head, said resilient twin beam structure comprising a face side beam extending between said face side of said handle and said face side of said brush head and a back side beam extending between and substantially rigidly connected to said back side of said handle and said back side of said brush head, said back side beam including in its at rest configuration a point of formed weakness intermediate said first end and said second end of said resilient twin beam structure which will permit said back side beam to behave as an upwardly convex arch when said back side beam is initially subjected to compressive stress and said face side beam is initially subjected to tensile stress resulting from the user gripping said handle and bringing the bristles on said brush head in contact with their teeth and gums, the predetermined force may be exerted on the user's teeth and gums being limited by the maximum compressive force which said back side beam can resist before it ceases to function as an upwardly convex arch and undergoes temporary and resilient buckling and deformation sufficient to cause it to invert to a downwardly convex configuration, thereby providing a simultaneous visual and tactile signal to the brush user that a predetermined brushing force has been exceeded.

3. The toothbrush of claim 2, wherein said back side beam tapers in crosssection from said first end to said point of formed weakness.

4. The toothbrush of claim 2, wherein said point of formed weakness in said back side beam comprises an incremental step to a smaller cross-section.

5. The toothbrush of claim 2, wherein said point of formed weakness in said back side beam comprises a hinge.

6. The toothbrush of claim 1 or claim 2, wherein said face side beam exhibits a substantially uniform cross-section substantially throughout its length.

7. The toothbrush of claim 1 or claim 2, wherein said face side beam contains a point of formed weakness intermediate said first end and said second end of said resilient twin beam structure.

8. The toothbrush of claim 7, wherein said point of formed weakness in said face side beam comprises a hinge.

9. A toothbrush comprising a handle having a face side and a back side opposite said face side and a brush head having a face side which carries a cleansing medium for cleaning the user's teeth and gums and a back side opposite said face side, said toothbrush further including a force indicator which simultaneously visually and tactually signals the user when a predetermined brushing force is exceeded, said force indicator comprising a resilient twin beam structure having a first end connected to said brush handle and a second end connected to said brush head, said resilient twin beam structure comprising a face side beam extending between said face side of said handle and said face side of said brush head and a back side beam extending between and substantially rigidly connected to said back side of said handle and said back side of said brush head, wherein said back side beam convergently tapers from said first end in the direction of said second end relative to said face side beam to form an acute angle therebetween, said back side beam exhibiting an arched at rest configuration including a point of formed weakness intermediate said first end and said second end of said resilient twin beam structure which will permit said back side beam to behave as an upwardly convex arch when said back side beam is initially subjected to compressive forces and said face side beam is initially subjected to tensile forces resulting from the user gripping said handle and bringing the cleansing medium on said brush head in contact with their teeth and gums, the predetermined force which may be exerted on the user's teeth and gums being limited by the maximum compressive force which said back side beam can resist before it ceases to function as an upwardly convex arch and undergoes temporary and resilient buckling and deformation sufficient to cause it to invert to a downwardly convex configuration, thereby providing a simultaneous visual and tactile signal to the brush user that a predetermined brushing force has been exceeded.

10. A toothbrush comprising a handle having a face side and a back side opposite said face side an brush head having a face side which carries bristles for cleaning the user's teeth and gums and a back side opposite said face side, said toothbrush further including a force indicator which simultaneously visually and tactually signals the user when a predetermined brushing force is exceeded, said force indicator comprising a resilient twin beam structure having a first end connected to said brush handle and a second end connected to said brush head, said resilient twin beam structure comprising a face side beam extending between said face side of said handle and said face side of said brush head and a back side beam extending between and substantially rigidly connected to said back side of said handle and said back side of said brush head, wherein said back side beam convergently tapers from aid first end in the direction of said second end relative to said face side beam to form an acute angle therebetween, said back side beam including in its at rest configuration a point of formed weakness intermediate said first end and said second end of said resilient twin beam structure which will permit said back side beam to behave as an upwardly convex arch when said back side beam is initially subjected to compressive forces and said face side beam is initially subjected to tensile forces resulting from the user gripping said handle and bringing the bristles on said brush head in contact with their teeth and gums, the predetermined force which may be exerted on the user's teeth and gums being limited by the maximum compressive force which said back side beam can resist before it ceases to function as an upwardly convex arch and undergoes temporary and resilient buckling and deformation sufficient to cause it to invert to a downwardly convex configuration, thereby providing a simultaneous visual and tactile signal to the brush user that a predetermined brushing force has been exceeded.

11. The toothbrush of claim 10, wherein said back side beam tapers in cross-section from said first end to said point of formed weakness.

12. The toothbrush of claim 10, wherein said point of formed weakness in said back side beam comprises an incremental step to a smaller cross-section.

13. The toothbrush of claim 10, wherein said point of formed weakness in said back side beam comprises a hinge.

14. The toothbrush of claim 9 or claim 10, wherein said face side beam contains a point of formed weakness intermediate said first end and said second end of said resilient twin beam structure.

15. The toothbrush of claim 14, wherein said point of formed weakness in said face side beam comprises a hinge.

* * * * *

UNITED STATES PATENT AND TRADEMARK OFFICE

CERTIFICATE OF CORRECTION

PATENT NO. : 5,146,645

DATED : September 15, 1992

INVENTOR(S) : ROBERT S. DIRKSING

It is certified that error appears in the above-identified patent and that said Letters Patent is hereby corrected as shown below:

Column 3, line 31, "Fig." should read -- Figs. -- .
Column 3, line 39, "bundle" should read -- bundles -- .
Column 4, line 24, "displace" should read -- displaced -- .
Column 4, line 27, "C" should read -- C′ -- .
Column 5, line 3, "illustrate" should read -- illustrated -- .
Column 5, line 18, "polyporpylene" should read -- polypropylene -- .
Column 5, line 25, "L[" should read -- L -- .
Column 5, line 50, "member" should read -- members -- .
Column 5, line 52, "polyporpylene" should read -- polypropylene -- .
Column 6, line 5, "0.25" should read -- 0.2 -- .
Column 6, line 50, "D" should read -- D′ -- .
Column 7, line 28, "and" should read -- an -- .
Column 7, line 48, "invention" should read -- inversion -- .
Column 7, line 67, "bristly" should read -- bristle -- .
Column 10, line 48, after "force" insert -- which -- .
Column 10, line 58, "crosssection" should read -- cross-section -- .
Column 11, line 47, "an" should read -- and a -- .
Column 12, line 12, "aid" should read -- said -- .

Signed and Sealed this

Twenty-eighth Day of September, 1993

Bruce Lehman

*Attest:*

BRUCE LEHMAN

*Attesting Officer*

*Commissioner of Patents and Trademarks*